US006415998B1

(12) United States Patent
Splinter

(10) Patent No.: US 6,415,998 B1
(45) Date of Patent: Jul. 9, 2002

(54) CIRCUIT GRINDING APPARATUS WITH HIGH PRESSURE ROLLER MILL AND SIFTER

(75) Inventor: Christian Splinter, Pulheim (DE)

(73) Assignee: KHD Humboldt Wedag AG, Cologne (DE)

( * ) Notice: Subject to any disclaimer, the term of this patent is extended or adjusted under 35 U.S.C. 154(b) by 0 days.

(21) Appl. No.: 09/684,134

(22) Filed: Oct. 10, 2000

(30) Foreign Application Priority Data

Oct. 9, 1999 (DE) ..... 199 48 727

(51) Int. Cl.[7] ..... B02C 23/12

(52) U.S. Cl. ..... 241/74; 241/80; 241/97; 241/235

(58) Field of Search ..... 241/236, 74, 80, 241/97, 235

(56) References Cited

U.S. PATENT DOCUMENTS 4,134,556 A * 1/1979 Ehrlich et al. ..... 241/101.2
4,824,028 A * 4/1989 Rota ..... 241/236
5,918,823 A * 7/1999 Strasser et al. ..... 241/61
6,032,887 A * 3/2000 Strasser et al. ..... 241/79

* cited by examiner

*Primary Examiner*—Mark Rosenbaum
(74) *Attorney, Agent, or Firm*—Kevin W. Guynn; Sonnenschein Nath & Rosenthal

(57) ABSTRACT

In order to further develop a circuit grinding apparatus with roller mill or roller press for comminution of the material bed of granular material and with at least one integrated sifter, in which mill and sifters are arranged within two fixed side face walls with an interlying turnably borne material conveyor ring settable into rotation for an internal material circuit, so that seals between the fixed side face walls and the interlying material conveyor ring that is settable in rotation are no longer necessary, it is proposed according to the invention to combine the two fixed side face walls over a housing part that houses the rotatable material conveyor ring, especially a ring housing part, into a housing tightly enclosing the entire working space of the circuit grinding apparatus, and to arrange on the underside of the housing part at least one grinding material leakage discharge from the working space of the circuit grinding apparatus.

20 Claims, 2 Drawing Sheets

CIRCUIT GRINDING APPARATUS WITH HIGH PRESSURE ROLLER MILL AND SIFTER

BACKGROUND OF THE INVENTION

The invention relates to a circuit grinding apparatus with high-pressure roller mill for the pressure comminution of granular material and with at least one integrated sifter, in which both aggregates are arranged within two fixed side face walls and an interlying turnably borne material-conveyor ring settable into rotation for an internal material circulation, in which the material inflow occurs through one or several openings in one or in both housing-face walls from the side and the material outflow occurs likewise laterally through one or more openings in the housing-face wall.

In the known grinding apparatuses of the above-mentioned type (DE-A-196 30 687, corresponding to U.S. Pat. No. 5,918,823 and DE-A-197 26 523, corresponding to U.S. Pat. No. 6,032,887) it is a matter of very compact circuit grinding apparatuses with a high-pressure roller mill or roller press for the pressure comminution or material-bed comminution of granular material, and with integrated an sifter. There the two rollers of the roller mill or roller press are housed in a housing consisting of two fixed, that is non-rotating, side face walls, between which there is arranged a rotatably borne material conveyor ring settable into rotation by a rotary drive for an internal material circulation. This rotatably borne material conveyance of the housing rotates at, for example, about 40 to 80% of the critical rotating rate, i.e., the ring takes along the mill- or press-discharge material (scabbing material), according to formation of the lifting elements in the conveyor ring, into the region near of the upper apex point of the ring, and allows this material to fall from above into the roller gap, whereby the internal material circulation comes about. Bucket mechanisms or other space-demanding conveying members for the transport of the mill- or press-discharge material to the mill- or pres-inflow are eliminated. With the rotating material conveying ring, therefore, in the least space and with low expenditure for machinery there is achieved a multiple internal material circulation with multiple pass material bed stressing of the material, in which also relatively high material circulation loads brought about, for example, by reduced roller press pressures, are to be managed.

For the achievement of high finenesses in the milling material, in the housing of the known circuit grinding apparatuses a static and/or dynamic sifter is integrated, and the sifting air laden with the milling material is drawn off and separated from the fine material fraction outside of the circuit grinding apparatus.

In the known circuit grinding apparatuses the two revolving annular gaps between the rotating material conveyor ring and the two fixed, i.e. non-rotatable, side face walls must be sealed off even in the case of a sub-pressure in the working space, if grinding material is to be prevented from. passing through these annular gaps to the outside. In consequence of the in practice large diameters or of the rotating material conveyor ring, on the order of magnitude of, for example, 8 to 10 meters, even at lower rotating rates there are high relative velocities between the rotating material conveyance ring and the fixed side face walls, so that effective annular seals with such a great diameter would wear out relatively rapidly.

SUMMARY OF THE INVENTION

Underlying the invention is the problem of further developing a circuit grinding apparatus of the type mentioned at the outset, so that seals between the fixed side face walls and the interlying material conveyance settable in rotation are no longer necessary.

It is characteristic for the circuit grinding apparatus of the invention that the two fixed side face walls are combined over a housing part, for example an annular housing part, that houses the rotatable material conveyance ring inside a housing tightly enclosing the entire working space of the circuit grinding apparatus. For the reception of milling material leakages that can emerge through the two annular gaps between the rotatable material conveyance ring and the fixed side face walls, the housing part has on its underside at least one grinding material leakage discharge element such as, for example, a collecting funnel, for the discharge or collecting of such grinding material leakages, which (leakages) can advantageously be recirculated into the grinding circuit. At any rate, in the circuit grinding apparatus according to the invention there are not required any seals between the fixed side face walls and the interlying turnably borne material conveyance ring.

So that at least one sifter integrated into the circuit grinding apparatus of the invention can be arranged above or below the roller mill, according to a special feature of the invention, in the working space of the circuit grinding apparatus, underneath the roller mill there can be arranged two static cascade sifters, lying about in mirror image to one another, and on the underside of the housing for the reception of grinding material leakages, there can also be arranged two grinding material leakage discharges, such as, for example, collecting funnels, for the reception of such leakages.

For the facilitation of its assembling, the fixed housing part encapsulating the rotatable material conveyance ring, in particular an annular housing part which simultaneously offers an optimal protection according to the work security guidelines, can be divided, in particular divided in half.

BRIEF DESCRIPTION OF THE DRAWINGS

The invention and its further features and advantages are explained in more detail with the aid of the example of execution schematically represented in the figures.

DETAILED DESCRIPTION OF THE PREFERRED EMBODIMENTS

Figure 1:
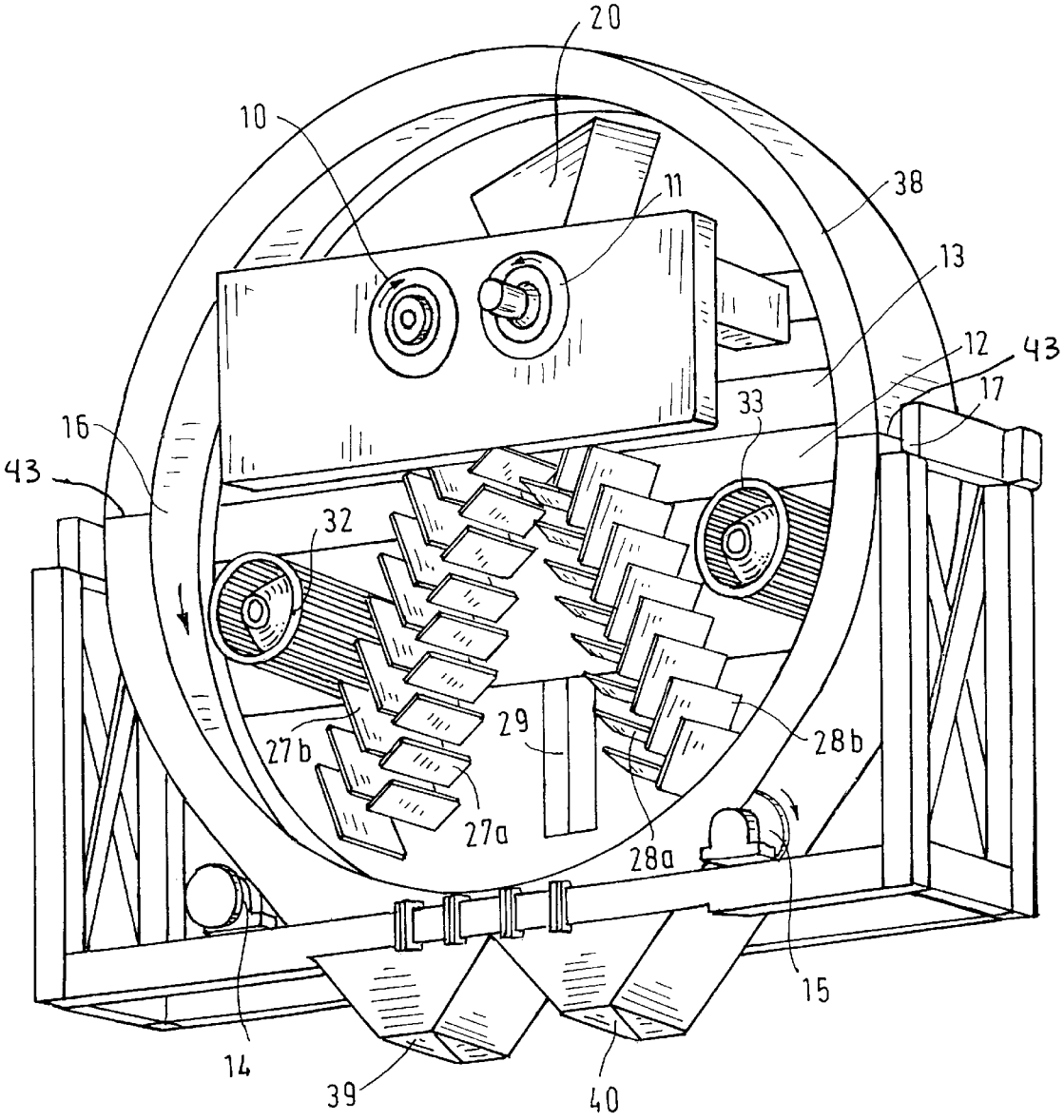
FIG. 1 shows in perspective representation with partly cut-out machine housing parts, the circuit grinding apparatus of the invention with material bed roller mill, or roller press as well as several integrated sifters.

In the circuit grinding apparatus of the invention with the high pressure roller mill or roller press integrated in the working space for the material bed comminution of granular material with the two rollers 10, 11 oppositely driven and separated from one another by a roller gap, and with the integrated at least one sifter, both the mill and also the sifting device are surrounded by, or housed in a housing consisting of two fixed, i.e. non-rotating housing side face walls 12, 13 (front face wall 12 represented transparent, rear face wall 13), between which, on rollers 14, 15, there is arranged a rotatably borne material conveying ring 16 for an internal material circulation. The rotation of the material conveying ring 16 occurs over its cylindrical shell, for example by the driven bearing roller 15. The bearing blocks of the two rollers 10, 11 as well as of the two rollers 14, 15 are borne outside of the two housing face walls 12, 13, in the machine frame 17, the upper and front parts of which have been omitted in FIG. 1.

Figure 2:
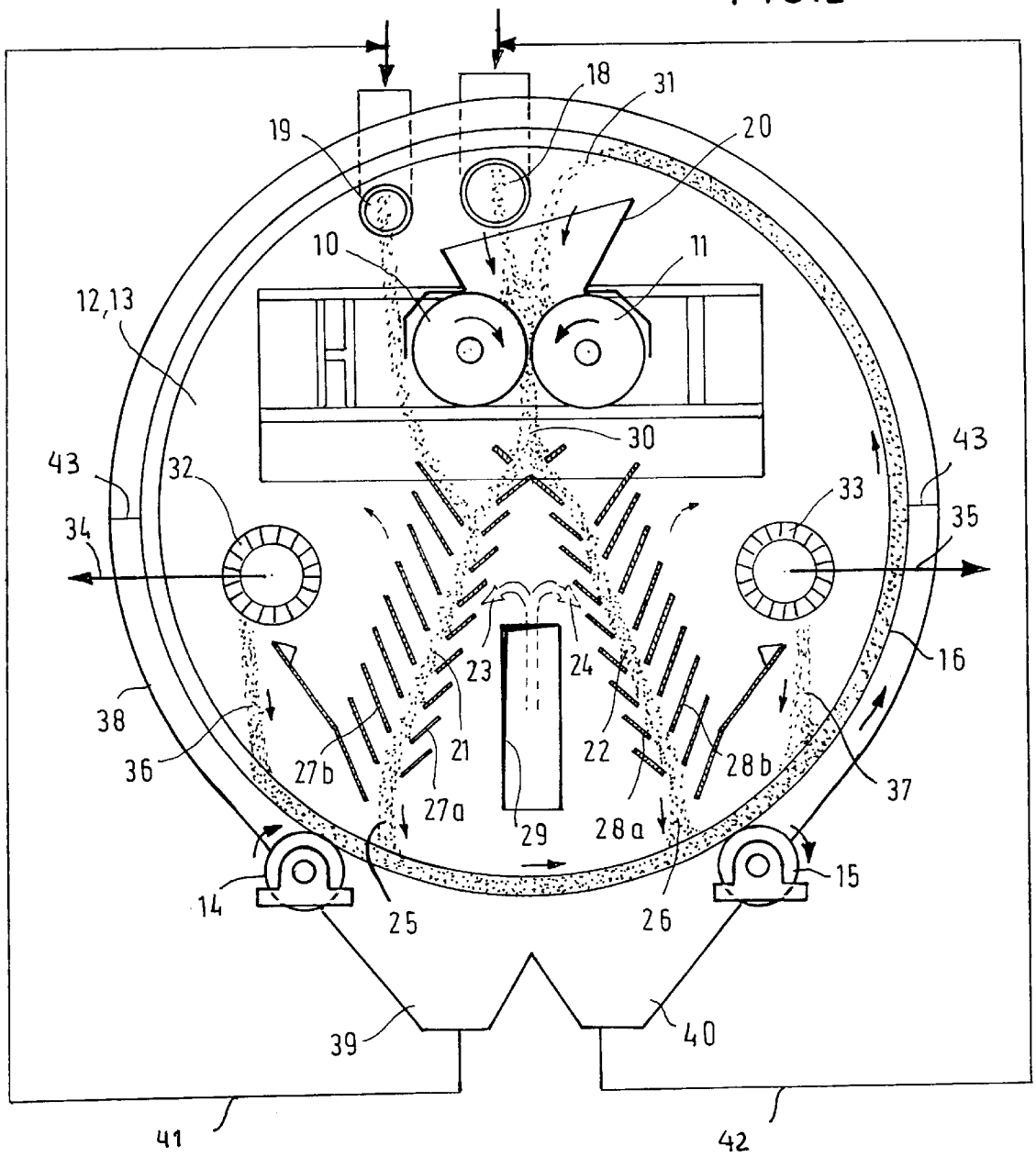
FIG. 2 shows the frontal view of the circuit grinding apparatus of FIG. 1, with view into the interior of the grinding and sifting space.

According to FIG. 2 the material to be ground is fed through openings 18 and 19 in one or in both housing face walls 12, 13, into the working space of the circuit grinding apparatus, and, namely, through opening 18 directly into the material feed shaft 20 of the roller mill and/or through opening 19 into the space underneath the roller mill. In this space in the example of execution, for example, there are arranged two static cascade sifters lying in mirror image boundary walls forming a sifting zone 21 and a sifting zone 22, respectively, through which there flows the sifting air 23, 24, or the hot gas as drying gas, say in cross flow, which walls have guide plates 27*a*, 27*b* and 28*a*, 28*b*, respectively, inclined obliquely downward in cascade manner or in Venetian blind manner for the discharge of the sifted-out coarse grain fraction, these two guide plate walls and therewith the interlying sifting zone 21, 22 being arranged at an angle differing from the vertical.

The entry opening 29 for the sifting air 23/24 or for the drying gas is located in one or in both housing face walls 12, 13. The material scabs 30 emerging downward from the roller gap of the material bed roller mill 10, 11 are quantitatively divided and, possibly together with fresh grinding material, introduced through the opening 19, delivered to the cascade sifters. In the falling or in the slipping of the material over the guide plate walls of the cascade sifter, the sifting material is sifted in cross flow and material agglomerates are simultaneously disagglomerated. In the case of moist sifting material, such as, for example, in the case of moist cement raw meal, the latter is simultaneously effectively dried when a hot gas is used as sifting medium. Instead of the guide plate walls 27*a*, 27*b* and 28*a*, 28*b* there could also be used perforated plates such a sieve plates, etc.

The coarse grain fraction 25, 26 separated from the sifting material by the static cascade sifters, passes over the inner track of the rotating material conveying ring 16, that is possibly provided with lifting elements, which entrains this coarse grain fraction upward toward the upper apex point of the material conveying ring 16, and casts off this material 31 into the feed shaft 20 of the roller press 10, 11, so that this grinding material is subjected to a repeated or multiple material bed comminution, which in this respect is unburdened by fine material. The fine material fraction together with the sifting air leaves the static cascade sifters and is subjected to a further sifting process in downstream dynamic sifters with, in each case, a rotatably borne bar basket 32, 33, the bearings of which are advantageously arranged outside the two fixed housing face walls 12, 13. In the region of the ends of the bar baskets 32, 33 the sifting air 34, 35 laden with fine material is drawn off, for example over angle pieces (not represented), and the further coarse grain faction 36, 37 separated off at the periphery of the bar baskets 32, 33, passes likewise onto the inner track of the rotatable material conveying ring 16 and is recirculated to the material bed roller mill. There is also present, however, the possibility, to provide a material discharge opening of its own in at least one of the two housing face walls 12, 13, for the discharge of a partial stream of the coarse grain fraction 25, 26 and 36, 37, respectively, in their lower region.

The two fixed side face walls 12, 13 are combined, over a ring housing part 38 that houses the rotatable material conveying ring 16, into a housing tightly enclosing the entire working space of the circuit grinding apparatus, i.e. the fixed ring housing part 38 as well as the fixed face walls 12 are closely joined with one another. Therewith the circuit grinding apparatus of the invention is completely encapsulated. Seals between the two fixed side face walls 12, 13 and the interlying turnably borne rotatable material conveyor 16 are eliminated. Possible grinding material leakages, that can allow some grinding material to escape from inside to outside through these two annular gaps, are caught up on the underside of the annular housing part 38, and they pass into the grinding material leakage discharges arranged on the underside of the annular housing part, such as, for example, collecting funnels 39, 40, from where the collected leakage ground material can be recirculated to the material inflow controlled via a conveying member (schematically represented at 41, 42).

In the circuit grinding apparatus of the invention there still occur only very slight leakage air streams at the few still remaining housing break-through points, namely at the passage places of the drive shafts for the roller press, for the sifter bar baskets as well as for the rotary drive of the material conveying ring 16, in each case through the housing side wall. Furthermore, the very-compact circuit grinding apparatus with the tunably borne rotating material conveyor ring 16 is optimally protected by the annular housing part 38 of the invention, which, for reasons of assembly simplification is advantageously divided, especially in half as at parting line 43.

The material conveying ring 16 can be operated at a subcritical speed, for example, at about 40 to 80% of its critical rotating speed, or also at hypercritical speed, for example, at 1 to 1.3 times the critical rotating rate. In the latter case a material stripping device is arranged in the region of the upper apex point of the rotating material conveying ring 16.

The invention also would be also usable for a ring-roller mill with a turnably borne grinding ring 16, on the cylindrical inner wall or grinding track of which there is pressable from inside a grinding roller of smaller diameter for the purpose of individual grain comminution and/or for the material bed comminution of the grinding material.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A circuit grinding apparatus having an internal working space with a high pressure roller mill for a pressure comminution of granular material and with at least one integrated sifter, in which both aggregates are arranged within two fixed side face walls, and with an interlying turnably borne material conveyor ring settable in rotation for an internal material circulation, in which a material inflow occurs from the side, through at least one in at least one housing face wall, and a material outflow likewise occurs laterally through at least one opening in at least one of the housing face walls, wherein the two fixed side face walls are combined, over a housing part that houses the rotatable material conveyor ring, into a housing tightly enclosing the entire working space of the circuit grinding apparatus, and the housing part has on its underside at least one grinding material leakage discharge element for the leakage from the working space.

2. A circuit grinding apparatus according to claim 1, wherein in a working space of the circuit grinding apparatus there are arranged, underneath the roller mill, two static cascade sifters and on the underside of the housing part there are arranged two grinding material leakage discharges, for the reception of the grinding material leakages.

3. A circuit grinding apparatus according to claim 1, wherein said at least one grinding material leakage discharge element comprises a funnel.

4. A circuit grinding apparatus according to claim 1, wherein a solid matter discharge point for the at least one grinding material leakage discharge element is in communication with the material inflow, via a conveyor member.

5. A circuit grinding apparatus according to claim 1, wherein said housing part is in the shape of a ring.

6. A circuit grinding apparatus according to claim 1, wherein the housing part is divided.

7. A circuit grinding apparatus according to claim 6, wherein said housing part is divided in half.

8. A circuit grinding apparatus comprising two fixed side face walls and an interlying rotatable material conveyor ring defining therebetween an internal working space;

a high pressure roller mill located in said space for a pressure comminution of grannular material;

at least one integrated sifter located in said space;

a material inlet formed by at least one opening in at least one of said face walls;

a material outlet formed by at least one opening in at least one of said face walls;

a housing part combining said two face walls, enclosing said rotatable material conveyor ring, and forming a housing tightly enclosing said working space; and at least one grinding material leakage discharge element formed on an underside of said housing part for collecting any material leakage from said working space.

9. A circuit grinding apparatus according to claim 8, wherein said at least one integrated sifter comprises two static cascade sifters.

10. A circuit grinding apparatus according to claim 8, wherein said at least one ground material leakage discharge element comprises two grinding material leakage discharge elements.

11. A circuit grinding apparatus according to claim 8, wherein said at least one grinding material leakage discharge element comprises a funnel.

12. A circuit grinding apparatus according to claim 8, wherein said at least one grinding material leakage discharge element is in communication with said material inlet via a conveyor.

13. A circuit grinding apparatus according to claim 8, wherein said housing part is formed in two pieces.

14. A circuit grinding apparatus according to claim 8, wherein said housing part is formed in the shape of a ring.

15. A circuit grinding apparatus comprising two fixed side face walls arranged parallel to and spaced apart from one another;

a rotatably mounted ring shaped wall lying between and closely adjacent to said two fixed walls defining therebetween a substantially closed internal working space;

a high pressure roller mill located in said space for a pressure comminution of grannular material;

at least one sifter located in said space;

a material inlet formed by at least one opening in at least one of said face walls;

a material outlet formed by at least one opening in at least one of said face walls;

a housing part combining said two face walls, enclosing said rotatable material conveyor ring, and forming a housing tightly enclosing said working space; and at least one grinding material leakage discharge element formed on an underside of said housing part for collecting any material leakage from said working space.

16. A circuit grinding apparatus according to claim 15, wherein said at least one integrated sifter comprises two static cascade sifters.

17. A circuit grinding apparatus according to claim 15, wherein said at least one ground material leakage discharge element comprises two grinding material leakage discharge elements.

18. A circuit grinding apparatus according to claim 15, wherein said at least one grinding material leakage discharge element comprises a funnel.

19. A circuit grinding apparatus according to claim 15, wherein said at least one grinding material leakage discharge element is in communication with said material inlet via a conveyor.

20. A circuit grinding apparatus according to claim 15, wherein said housing part is formed in two pieces.

* * * * *